US005283911A

United States Patent [19]

DeMars

[11] Patent Number: 5,283,911

[45] Date of Patent: Feb. 8, 1994

[54] SNAP-ON ATTACHMENT FOR WEARING APPAREL

[76] Inventor: Robert A. DeMars, 23221 Ladrillo Ave., Woodland Hills, Calif. 91367

[21] Appl. No.: 1,589

[22] Filed: Jan. 7, 1993

Related U.S. Application Data

[63] Continuation-in-part of Ser. No. 926,283, Aug. 10, 1992, Pat. No. 5,177,812, and a continuation-in-part of Ser. No. 972,849, Nov. 6, 1992.

[51] Int. Cl.[5] ..... A42B 1/24

[52] U.S. Cl. ..... 2/209.13; 362/34; 362/106

[58] Field of Search ..... 2/185 R, 186, 196, 199, 2/209.1, 209.2, 422; 40/541, 542, 544; 252/700; 362/34, 84, 103, 104, 105, 106, 107, 108

[56] References Cited

U.S. PATENT DOCUMENTS 4,061,910 12/1977 Rosenfeld ..... 362/34

4,177,812 1/1993 DeMars ..... 2/209.2

5,213,405 5/1993 Giglia ..... 362/34

*Primary Examiner*—Clifford D. Crowder

*Assistant Examiner*—Diana L. Biefeld

*Attorney, Agent, or Firm*—Jack C. Munro

[57] ABSTRACT

The including of an engagable flange with an article of human wearing apparel, such as a cap, that has a specific exterior ornamental configuration. An elongated, illuminatable, plastic, light tube, which includes an elongated resilient gap, is to be snapped onto the flange formed on the wearing apparel and is to be snugly retained thereon. The light tube is to be flexible so as to accommodate to the specific shape of flange. The illuminatable tube includes a liquid which is to be activatable which will cause the tube to glow for a period of time. Also, the body of the tube will contain a separate light activatable substance which can be used to cause the tube to emit light after expiration of the light from the liquid.

5 Claims, 1 Drawing Sheet

SNAP-ON ATTACHMENT FOR WEARING APPAREL

REFERENCE TO PRIOR APPLICATIONS

This application is a continuation-in-part of patent application Ser. No. 07/926,283, filed Aug. 10, 1992, entitled Illuminated Article of Wearing Apparel, now U.S Pat. No. 5,177,812, issued Jan. 12, 1993, and is also a continuation-in-part of patent application Ser. No. 07/972,849, filed Nov. 6, 1992, entitled Illuminated Article of Wearing Apparel With Afterglow.

BACKGROUND OF THE INVENTION

1. FIELD OF THE INVENTION

The field of this invention is directed to wearing apparel and more particularly to wearing apparel which can be modified to be illuminated for a period of time and can be reilluminated after termination of the original period of luminescence.

2. DESCRIPTION OF PRIOR ART

The use of wearing apparel that has a specific exterior ornamental configuration has long been known. One common type of such wearing apparel is headwear. There are numerous types of hats, caps, beenies and so forth. At times, headwear may represent a particular desired configuration such as "Mickey Mouse ears".

Ornamental headwear wearing apparel is frequently sold within certain environments as a novelty item. Such environments would be theme parks. Generally, children are the principal users of such headwear and, the more attractive the manufacturing of such headwear the greater the enducement for the child to purchase and use the headwear.

Within recent years, a new type of novelty item that has become of common use within recreational facilities, such as theme parks, is what is frequently referred to as a glow tube. The glow tube is an elongated plastic thin tube which can be readily bent in any desired configuration. Within the interior of the glow tube there is incorporated an activatable substance. Upon the glow tube being manually grasped and rapidly bent back and forth, this substance is activated and light is emitted. This emitting of light causes the tube to glow and the tube will continue to glow for a period of time such as generally four to eight hours. The disadvantage of such a novelty item is that no illumination is possible after this period of time. The purchaser, usually a child, would like to be able to obtain illumination at a later time, days and even months later.

The incorporation of a glow tube in conjunction with an article of wearing apparel of a specific ornamental configuration is disclosed within the above referenced U.S. Pat. No. 5,177,812. The above referenced prior patent application includes the incorporating of a glow tube that can be reactivated after termination of the initial period of illumination.

One disadvantage to the above referenced patent and patent application is that the wearing apparel is modified in design to include the glow tube. It would be advantageous to have the glow tube conveniently attach to existing wearing apparel eliminating any modifying of the wearing apparel.

SUMMARY OF THE INVENTION

The structure of the present invention is directed to an article of wearing apparel such as headwear. This headwear is to have a specific exterior configuration.

Along the outline of the ornamental configuration of the headwear there is attached a glow tube. The user is to purchase the headwear and then purchase the light activatable glow tube and, after activating of a liquid contained within the hollow interior of the glow tube, mount such on the headwear which thereby causes the headwear to be illuminated. The headwear is than to be worn by the user. The body of the glow tube is impregnated with a phosphoresecence material which is activatable by light. The user can then obtain one or more further illumination(s) of the tube after termination of the illumination of the liquid. This subsequent illumination can be obtained repeatedly with each such illumination being for a period of time, such as one hour.

The primary objective of the present invention is to construct a new type of novelty item which will be attractive to a particular type of user such as children.

Another objective of the present invention is to combine together two known types of novelty items which will then produce a newer and third type of novelty item which has heretofore been unknown.

Another objective of the present invention is to construct an attachment for a wearing apparel novelty item which can be manufactured inexpensively and which will then be sold to the ultimate consumer at an inexpensive price.

A further objective of this invention is to include an glow tube in a novelty item where further illumination is obtainable beyond the initial period of illumination.

A still further objective of this invention is to permit quick and easy attachment of a glow tube onto an article of wearing apparel.

DETAILED DESCRIPTION OF THE SHOWN EMBODIMENT

Figure 1:
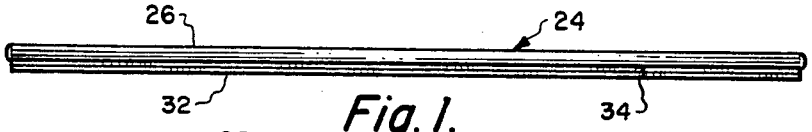
FIG. 1 is a side view of an illuminatable tube constructed according to this invention which is to be usable in conjunction with an article of wearing apparel showing the illuminatable tube in an unilluminated configuration.
Figure 2:
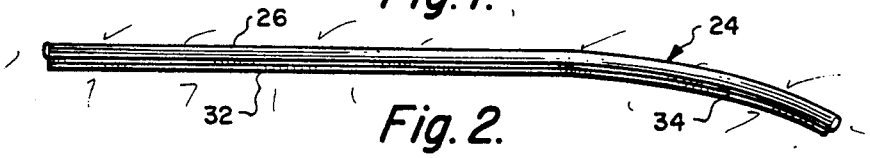
FIG. 2 is a view similar to FIG. 1 but showing the tube in the illuminated configuration and also showing the tube in a slightly bent configuration.
Figure 3:
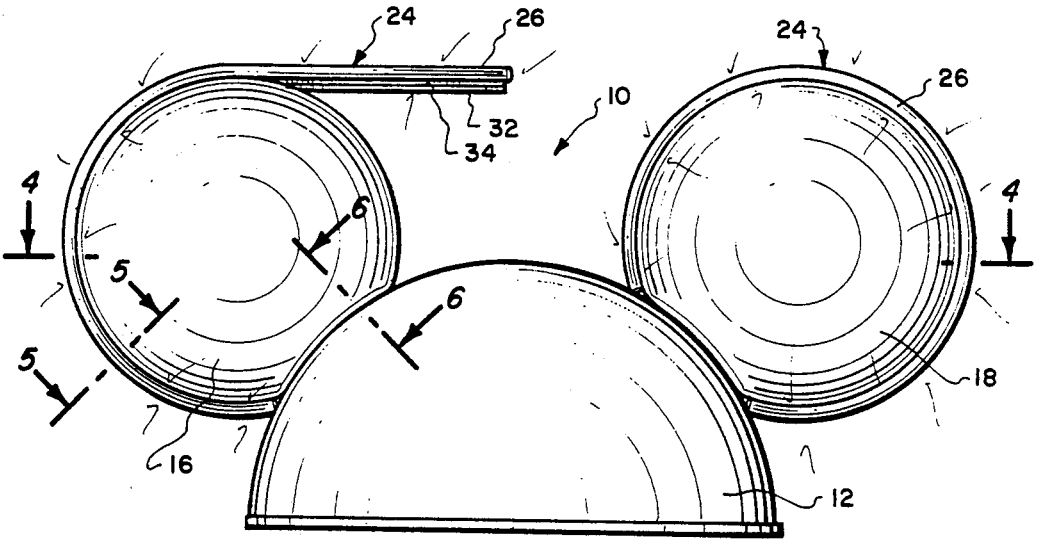
FIG. 3 is a front view of a conventional article of wearing apparel with which has been incorporated the illuminatable tube of FIGS. 1 and 2.
Figure 4:
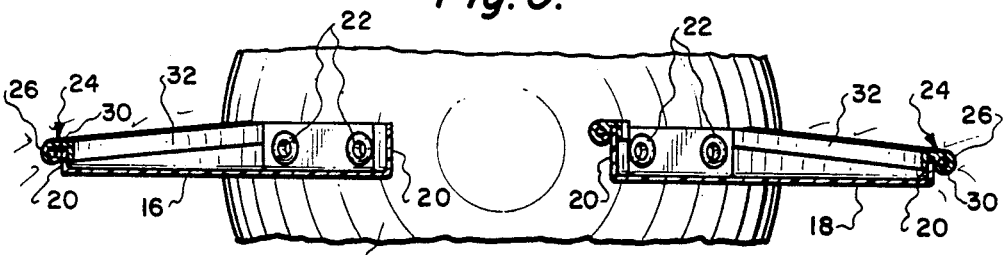
FIG. 4 is a cross-sectional view through a portion of the headwear taken along line 4—4 of FIG. 3 clearly showing the attaching of the illuminatable tube to the headwear.
Figure 5:
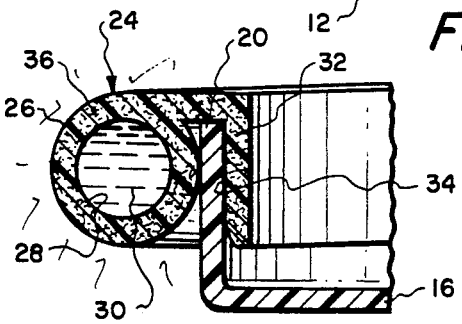
FIG. 5 is a cross-sectional view through another portion of the wearing apparel of FIG. 3 taken along line 5—5 of FIG. 3.
Figure 6:
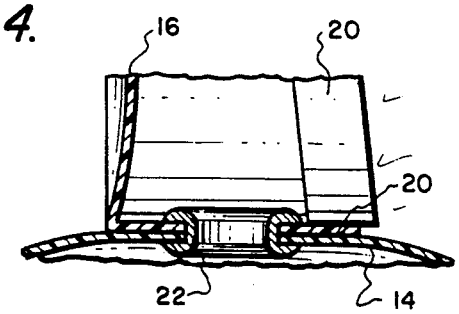
FIG. 6 is a cross sectional view through the headwear taken along line 6—6 of FIG. 3.

It is to be understood that the structure of the present invention is shown in conjunction with a particular type of novelty headwear. However, it is considered to be within the scope of this invention that the concept of this invention could be utilized with other types of headwear as well as other types of wearing apparel for humans. For example, it is believed that the structure of this invention could be incorporated within other rigid wearing apparel such as belts and shoes.

Referring particularly to the drawing, there is shown a headwear 10 which has a particular type of exterior configuration. This headwear 10 includes a cap 12 which has a hollow internal chamber 14. The human head (not shown) is to be located within the internal chamber 14. Exteriorly of the cap 12 and mounted thereon there are a pair of spaced apart protrusions 16 and 18. Protrusion 16 and 18 are substantially identical and each include a rearward extending flange 20. Protrusions 16 and 18 form a design in conjunction with cap 12, that being "Mickey Mouse Ears".

The flange 20 of each protrusion 16 and 18 is attached to the cap 12 by means rivets 22. There are two in number of rivets 22 for protrusion 16 and two in number of rivets 22 for protrusion 18. The wearing apparel 10, in form of the cap 12 and protrusions 16 and 18, is deemed to be conventional and forms no specific part of this invention.

It is desirable to illuminate the peripheral edge of the protrusions 16 and 18 so that the headwear 10 can be observed at night. In order to achieve this there is utilized an illuminatable light tube 24. This illuminatable light tube 24 is normally made of plastic and includes an elongated cylindrically shaped body 26. Body 26 has a hollow interior chamber 28 within which is located a quantity of a chemically liquid substance 30. Substance 30 is to be activated by deforming of the body 26 which will will cause the substance 30 to luminesce. This deforming can be acheived by bending of the body 26 through a an arc with a suffieciently small enough radius to result in intermixing of different ingredients contained within the liquid substance 30. The different ingredients react chemically to excite a material in the liquid substance 30 which fluoresces and produces chemiluminescent light. This light is visible exteriorly of body 26. This light emission will then be sufficient to illuminate the outline of the headwear 10. The substance 30 is proprietary to the manufacturer of the glow tube 24.

The body 26 has attached thereto an L-shaped member 32. L-shaped member 32 is of the same length as body 26. Between the long leg of the L-shaped member 32 and the body 26 there is formed a gap 34. Within the confines of the gap 34 there is resiliently clamped there between the flange 20. Thus clamping action provides the securement between the tube 24 and the protrusions 16 and 18. It is to understood that normally there would be a single length of the tube 24 connected to the protrusion 16 and then another identical length of tube 24 being connected t the protrusion 18.

The obtaining of chemiluminescent light can be by the reaction of a catalyzed hydrogen peroxide solution with a fluorescer solution. Blue, green and yellow chemiluminescent light has been produced depending upon the particular fluorescer employed in the fluorescer solution. Examples of these prior art chemiluminescent light-systems can be found in one or more of the following U.S. Pat. Nos. 3,749,679; 3,391,068; 3,391,069; 3,974,368; 3,557,233; 3,597,362; 3,775,336; and 3,888,786.

The body 26 and L-shaped member 32 of tube 24 is to be impregnated with a fluorescent compound 36, either in liquid or powder form. Compound 36 is to be activated by light, not by deformation. Compound 36 can be activated a multitude of times. Each time the tube 24 will glow for a period of time such as one or two hours. Compound 36 can comprise anyone of several known fluorescent compounds such as are described within "Fluorescence and Phosphorescence" by Peter Pringsheim, Interscience Publishers, Inc., New York, N.Y., 1949, or within "The Colour Index", Second Edition, Volume 2, The American Association of Textile Chemists and Colorists, 1956, pp. 2907-2923.

What is claimed is:

1. An article of wearing apparel comprising:

a housing, said housing adapted to fit onto a portion of the body of a human, said housing having a specific ornamental exterior configuration;

an elongated illuminating tube in the form of a body having a hollow interior chamber, said elongated illuminating tube being flexible permitting bending to any desired configuration, said hollow interior chamber including an activatable liquid substance, said activatable liquid substance being selectly activatable so as to emit light for a first period of time, said body being impregnated with a light activatable substance which will cause said body to emit light after expiration of said first period of time for a second period of time; and connection means formed on said elongated illuminating tube, said connection means clampingly securely engaging said housing, said activatable liquid substance being activated to cause said elongated illuminating tube to glow, each tube being engaged with said housing and said housing being capable of being worn by the human, said connection means comprising an L-shaped member, an elongated gap formed between said L-shaped member and said body, said housing having a flange, said flange being resiliently and tightly locatable within said gap, said elongated illuminating light tube being manually disengagable from said housing.

2. The article of wearing apparel as defined in claim 1 wherein:

said flange outlines said specific ornamental exterior configuration.

3. The article of wearing apparel as defined in claim 2 wherein:

said article of wearing apparel comprises headwear.

4. The article of wearing apparel as defined in claim 3 wherein:

said light activatable substance is reactivatable after expiration of said second period of time.

5. The article of wearing apparel as defined in claim 4 wherein:

said second period of time is shorter than said first period of time.

* * * * *